US007365492B2

(12) United States Patent
Hong et al.

(10) Patent No.: US 7,365,492 B2
(45) Date of Patent: Apr. 29, 2008

(54) PLASMA DISPLAY PANEL

(75) Inventors: Gun-Young Hong, Suwon-si (KR); Sung-Hune Yoo, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 25 days.

(21) Appl. No.: 11/646,745

(22) Filed: Dec. 27, 2006

(65) Prior Publication Data

US 2007/0152583 A1 Jul. 5, 2007

(30) Foreign Application Priority Data

Dec. 31, 2005 (KR) ..... 10-2005-0136233

(51) Int. Cl.
*H01J 17/49* (2006.01)

(52) U.S. Cl. ..... 313/586; 313/584; 313/585

(58) Field of Classification Search ..... 313/582
See application file for complete search history.

(56) References Cited

U.S. PATENT DOCUMENTS 7,109,658 B2 * 9/2006 Yoo et al. ..... 313/586
2005/0035713 A1 2/2005 Yoo

FOREIGN PATENT DOCUMENTS

EP 0 762 462 A2 3/1997
KR 10-2004-0048173 6/2004
KR 10-2005-0019213 3/2005

OTHER PUBLICATIONS

Office Action dated Dec. 7, 2006 for corresponding Korean patent application No. 10-2005-0136233.
Korean Patent Abstracts, Publication No. 1020040048173 A; Publication Date: Jun. 7, 2004; in the name of Sik et al.
Korean Patent Abstracts, Publication No. 1020050019213 A; Publication date: Mar. 3, 2005; in the name of Kweon et al.
European Search Report dated May 21, 2007, for EP 061525652.5, in the name of Samsung SDI Co., Ltd.

* cited by examiner

*Primary Examiner*—David Bruce
*Assistant Examiner*—Conrad R Blease
(74) *Attorney, Agent, or Firm*—Christie, Parker & Hale, LLP

(57) ABSTRACT

Plasma display panels (PDPs) that can be readily manufactured and that have increased bright room contrast ratios are provided. One PDP includes a front substrate adapted to allow visible light to pass, a rear substrate facing the front substrate, and a plurality of barrier ribs disposed between the front substrate and the rear substrate defining a plurality of discharge cells. At least a portion of the barrier ribs is colored with a first color. The PDP further comprises a plurality of sustain electrodes disposed on the front substrate facing the rear substrate, each of which has a plurality of electrode parts. The PDP also includes a front dielectric layer disposed on the front substrate covering the sustain electrodes. The front dielectric layer is colored with a second color. Brightness and chroma of both of the first and second colors are reduced when the first and second colors are subtractively mixed.

20 Claims, 5 Drawing Sheets

PRIOR ART

PLASMA DISPLAY PANEL

CROSS-REFERENCE TO RELATED PATENT APPLICATION

This application claims priority to and the benefit of Korean Patent Application No. 10-2005-0136233, filed on Dec. 31, 2005 in the Korean Intellectual Property Office, the entire content of which is incorporated herein by reference.

BACKGROUND OF THE INVENTION

1. Field of the Invention

The present invention relates to plasma display panels, and more particularly, to plasma display panels that can be easily manufactured and that have high bright room contrast ratios.

2. Description of the Related Art

Plasma display panels have recently drawn attention as replacements for conventional cathode ray tube display devices. Plasma display panels are apparatuses that display images using visible light emitted through a process of exciting phosphor materials patterned with ultraviolet rays generated from the discharge of a discharge gas filled between two substrates on which a plurality of electrodes are formed.

FIG. 1 is a partially cutaway exploded perspective view of a conventional alternating current (AC) type plasma display panel (PDP) 10. Referring to FIG. 1, the PDP 10 includes an upper plate 50 where images are displayed and a lower plate 60 parallel to the upper plate 50. A sustain electrode pair 12, including an X electrode 31 and a Y electrode 32, is disposed on a front substrate 11 of the upper plate 50, and address electrodes 22, which are positioned perpendicular to the X electrode 31 and the Y electrode 32, are disposed on a rear substrate 21 of the lower plate 60 facing a surface of the front substrate 11 on which the sustain electrode pair 12 is disposed. A front dielectric layer 15 covering the sustain electrode pair 12 is formed on a rear surface of the front substrate 11, and a rear dielectric layer 25 covering the address electrodes 22 is formed on a front surface of the rear substrate 21. A protective layer 16 (usually formed of MgO) is formed on a rear surface of the front dielectric layer 15, and barrier ribs 30 (which maintain a discharge distance and prevent electrical and optical cross-talk between discharge cells) are formed on the entire surface of the rear dielectric layer 25. A phosphor layer 26 (including red, green and blue phosphor layers) is coated on both side walls of the barrier ribs 30 and on the surface of the rear dielectric layer 25 where the barrier ribs 30 are not formed.

The X electrode 31 and the Y electrode 32 include transparent electrodes 31*a* and 32*a* respectively, and bus electrodes 31*b* and 32*b* respectively. The space formed by the sustain electrode pair (i.e., the X electrode 31 and the Y electrode 32), and the address electrodes 22 is a discharge cell 70 and is one discharge unit. The transparent electrodes 31*a* and 32*a* are formed of a transparent material, such as indium tin oxide (ITO), that does not block the progress of light emitted from the phosphor material 26 (which is a conductive material) toward the front substrate 11. However, transparent materials such as ITO generally have high resistance. Accordingly, if the sustain electrode pair 12 is formed using only the transparent electrodes 31*a* and 32*a*, a large voltage drop occurs in the direction of the sustain electrode pair 12. Therefore, the consumption of driving power is high and response speed is low. To address these problems, bus electrodes 31*b* and 32*b* formed of a metal with a narrow line width are disposed on the transparent electrodes 31*a* and 32*a*.

However, in the X electrode 31 and the Y electrode 32 (which include the transparent electrodes 31*a* and 32*a* and the bus electrodes 31*b* and 32*b*), the transparent electrodes 31*a* and 32*a* are expensive and processes for manufacturing each of the transparent electrodes 31*a* and 32*a* and the bus electrodes 31*b* and 32*b* are required, thereby increasing manufacturing costs.

Also, the above PDP 10 has a low bright room contrast ratio due to very high reflective brightness.

SUMMARY OF THE INVENTION

In one embodiment, the present invention provides a plasma display panel having a structure that can be readily manufactured.

In another embodiment, the present invention provides a plasma display panel having a high bright room contrast ratio.

According to one embodiment of the present invention, a plasma display panel comprises a front substrate through which visible light passes; a rear substrate facing the front substrate; a plurality of barrier ribs disposed between the front and rear substrates and defining a plurality of discharge cells, wherein at least a portion of the barrier ribs are colored with a first color; a plurality of sustain electrodes disposed on the front substrate facing the rear substrate, each of which includes a plurality of electrode parts; and a front dielectric layer disposed on the front substrate covering the sustain electrodes, wherein the front dielectric layer is colored with a second color. Brightness and chroma of both of the first and second colors are reduced when the first and second colors are subtractively colored.

According to another embodiment of the present invention, a plasma display panel comprises a front substrate through which visible light passes; a rear substrate facing the front substrate and colored with a first color; a plurality of sustain electrodes disposed on the front substrate facing the second substrate, each of which has a plurality of electrode parts; and a front dielectric layer disposed on the front substrate covering the sustain electrodes, wherein the front dielectric layer is colored with a second color, wherein brightness and chroma of both of the first and second colors are reduced when the first and second colors are subtractively mixed.

According to another embodiment of the present invention, a plasma display panel comprises a front substrate through which visible light passes; a rear substrate facing the front substrate; a plurality of sustain electrodes disposed on the front substrate facing the rear substrate, each of which has a plurality of electrode parts; a front dielectric layer disposed on the front substrate covering the sustain electrodes, wherein the front dielectric layer is colored with a first color; a plurality of address electrodes positioned perpendicular to the sustain electrodes and disposed on the rear substrate facing the front substrate; and a rear dielectric layer disposed on the rear substrate covering the address electrodes, wherein the rear dielectric layer is colored with a second color, wherein brightness and chroma of both of the first and second colors are reduced when the first and second colors are subtractively mixed.

BRIEF DESCRIPTION OF THE DRAWINGS

The above and other features and aspects of the present invention will become more apparent by reference to the following detailed description when considered in conjunction with the attached drawings in which.

DETAILED DESCRIPTION

The present invention will now be described with reference to the accompanying drawings in which exemplary embodiments of the invention are illustrated.

Figure 1:
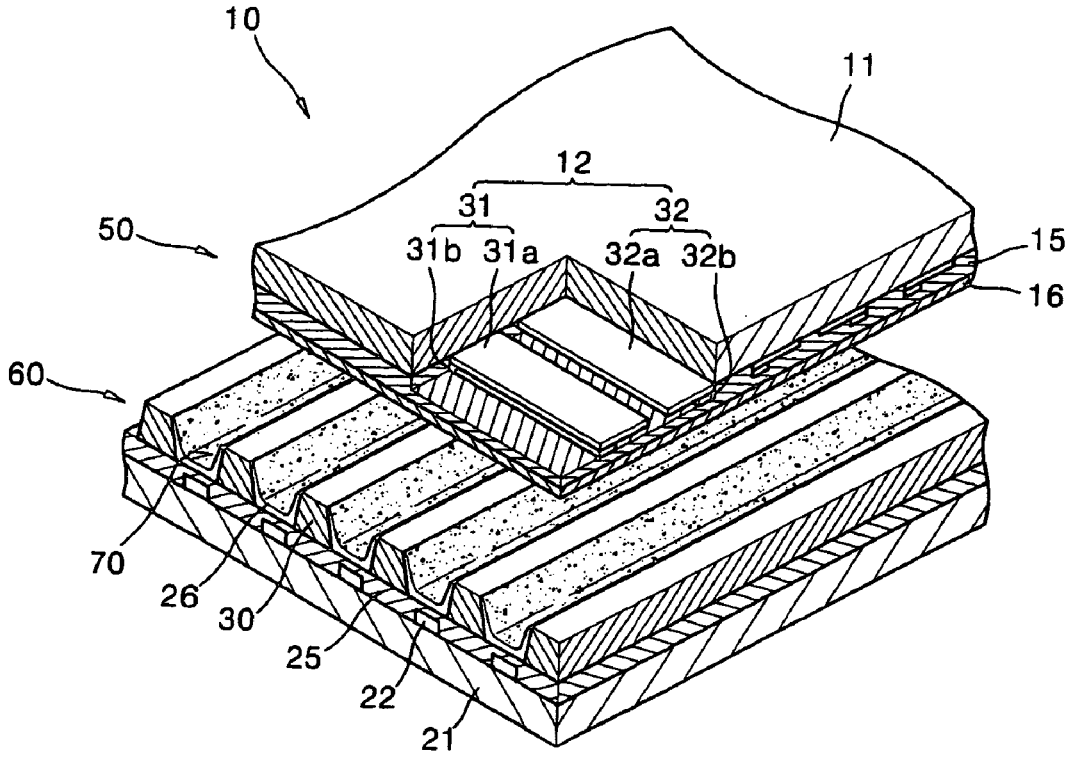
FIG. 1 is a partially cutaway exploded perspective view of a prior art alternating current (AC) type plasma display panel (PDP)
Figure 2:
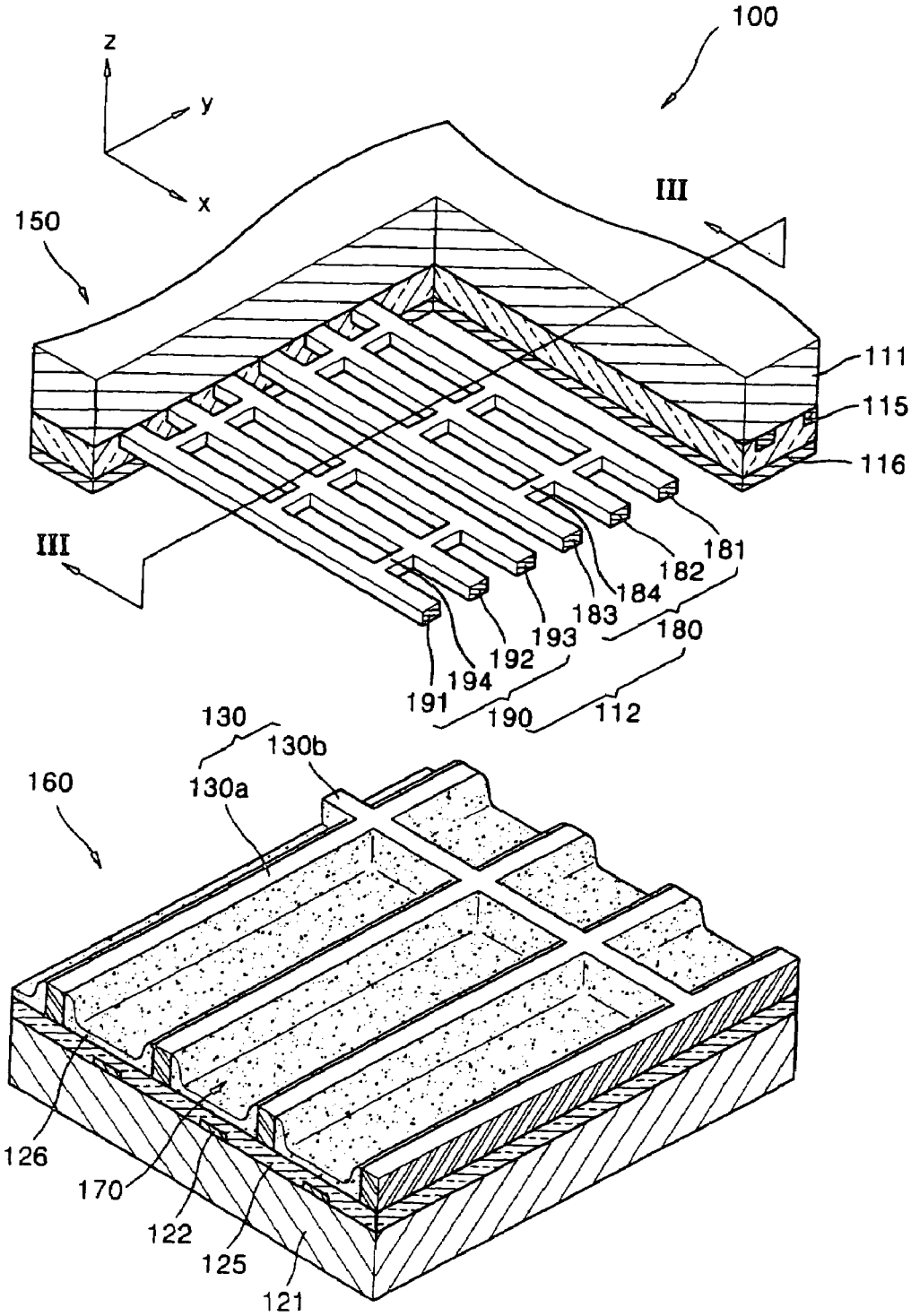
FIG. 2 is a partially cutaway exploded perspective view of a PDP according to one embodiment of the present invention.
Figure 3:
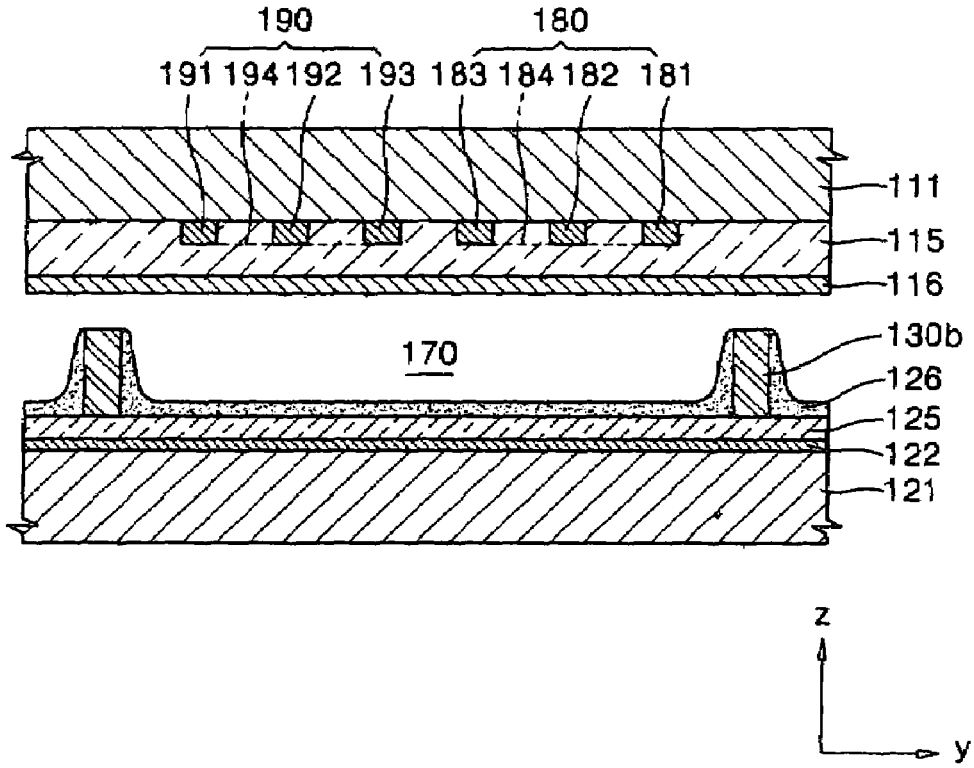
FIG. 3 is a cross-sectional view of the PDP of FIG. 2 taken along a line 111-111.
Figure 4:
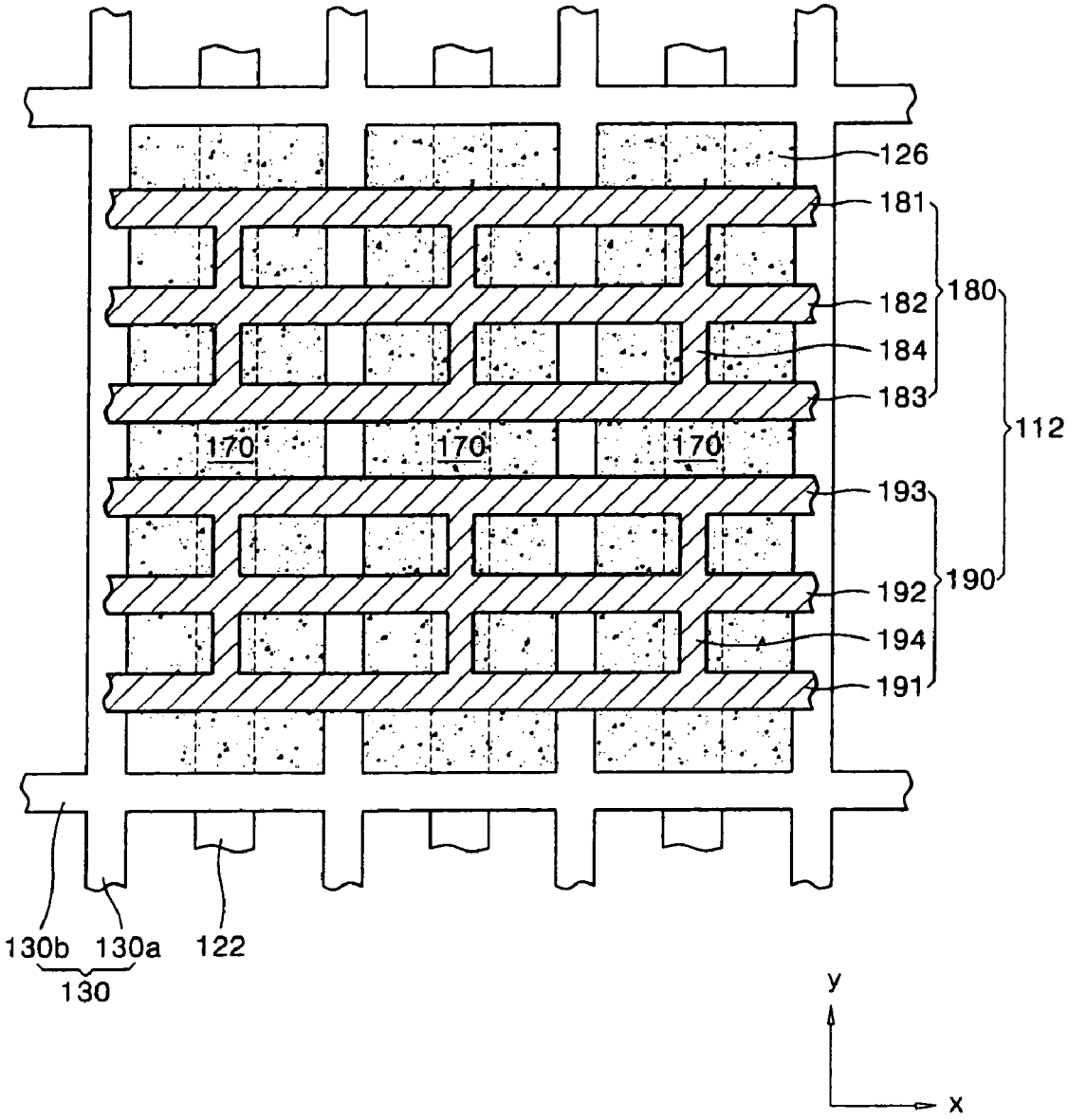
FIG. 4 is a plan view of the discharge cells and sustain electrodes of the PDP of FIG. 2.

Referring to FIGS. 2 through 4, an alternating current (AC) type plasma display panel (PDP) 100 according to one embodiment of the present invention is depicted. FIG. 2 is a partially cutaway exploded perspective view of the PDP 100. FIG. 3 is a cross-sectional view of the PDP taken along line III-III in FIG. 2, and FIG. 4 is a plan view illustrating an arrangement of the discharge cells 170, the barrier ribs 130, the sustain electrode pairs 112, and the address electrodes 122 of the PDP of FIG. 2.

The PDP 100 includes a front panel 150 and a rear panel 160 coupled together and facing each other. The front panel 150 includes a front substrate 111, a plurality of sustain electrode pairs 112, a protective layer 116, and a front dielectric layer 115. The rear panel 160 includes a rear substrate 121, a rear dielectric layer 125, a plurality of address electrodes 122, a plurality of barrier ribs 130, and a phosphor layer 126. A discharge gas (not shown) is filled in the space between the front panel 150 and the rear panel 160. The PDP 100 will now be described in detail.

The front substrate 111 is formed of a material having high light transmittance and having glass as the main constituent. Also, the rear substrate 121 and the front substrate 111 are disposed facing each other and separated from each other by a distance, and are formed of materials having high light transmittance such as glass.

The barrier ribs 130 define a plurality of discharge cells 170 where discharge is generated. These discharge cells 170 include red, green and blue light-emitting discharge cells. The discharge cells 170 are disposed between the front substrate 111 and the rear substrate 121. The barrier ribs 130 prevent optical cross-talk between the discharge cells 170. The barrier ribs 130 according to this embodiment of the present invention include first barrier ribs 130*a* disposed to extend in the direction (y direction) in which the address electrodes 122 extend, and second barrier ribs 130*b* disposed to extend in the direction (x direction) perpendicular to the first barrier ribs 130*a*. The discharge cells 170 have a generally rectangularly shaped horizontal cross-section. However, the shape of the barrier ribs 130 is not limited thereto, and as long as the barrier ribs 130 can define the discharge cells 170, the barrier ribs 130 can have various patterns. For example, the barrier ribs may be open-type barrier ribs having a strip shape, or closed-type barrier ribs having shapes such as waffles, matrices, deltas, etc. Also, the horizontal cross-section of the discharge space defined by closed-type barrier ribs can be polygonal, such as triangular or pentagonal in addition to rectangular. In addition, the horizontal cross-section of the discharge space may be circular or ovular.

The sustain electrode pairs 112 are disposed parallel to each other and spaced apart from each other by a distance on the front substrate 111 facing the rear substrate 121. Each of the sustain electrode pairs 112 includes an X electrode 180 and a Y electrode 190, and the X electrode 180 and the Y electrode 190 cause plasma discharge.

Each X electrode 180 includes a first electrode part 181, a second electrode part 182, a third electrode part 183, and connection parts 184. The first, second, and third electrode parts 181, 182, and 183, respectively, are disposed parallel to each other and spaced apart from each other by a distance, and extend in a direction (x direction) generally perpendicular to the address electrodes 122. The first, second, and third electrode parts 181, 182, and 183 are sequentially disposed beginning at an edge of the discharge cell 170 and moving toward the center of the discharge cell 170.

In this embodiment of the present invention, each of the X electrodes 180 includes the first, second, and third electrode parts 181, 182, and 183, but the present invention is not limited thereto. That is, each of the X electrodes 180 may include a plurality of electrode parts, for example, two to four electrode parts.

The connection parts 184 electrically connect the first, second, and third electrode parts 181, 182, and 183. In this embodiment of the present invention, one connection part 184 of the X electrode 180 is disposed in the central portion of each discharge cell 170. Each connection part 184 is disposed in the direction (y direction) substantially perpendicular to the first, second, and third electrode parts 181, 182, and 183, but the structure of the present invention is not limited thereto.

The first, second, and third electrode parts 181, 182, and 183 and the connection parts 184 of the X electrode 180 can be formed of various conductive materials, for example, a material containing metal or ceramic. Nonlimiting examples of suitable metals include Ag, Pt, Pd, Ni, Cu, and the like. Nonlimiting examples of suitable ceramics include indium tin oxide (ITO), antimony doped tin oxide (ATO), and the like. Also, to increase emission of secondary electrons, the first, second, and third electrode parts 181, 182, and 183 and the connection parts 184 of the X electrode 180 can be formed of a material containing carbon nanotubes.

The first, second, and third electrode parts 181, 182, and 183 and the connection parts 184 of the X electrode 180 can be formed in a single layer structure, but may also be formed in a multiple layer structure. If the first, second, and third electrode parts 181, 182, and 183 and the connection parts 184 of the X electrode 180 have a multiple layer structure, each layer can be formed of different materials.

To simplify the manufacturing process, the first, second, and third electrode parts 181, 182, and 183 and the connection parts 184 of the X electrode 180 may be formed as one unit. For example, each X electrode 180 can be formed as a thick film by printing a photosensitive paste. Alternatively, each X electrode 180 can be formed as a thin film by sputtering or evaporation. The first, second, and third electrode parts 181, 182, and 183 may be formed with substantially identical line widths B.

Each of the Y electrodes 190 also includes a first electrode part 191, a second electrode part 192, a third electrode part 193, and connection parts 194. In each discharge cell 170, the Y electrode 190 may have a shape symmetrical to the X electrode 180 for uniform discharge. The structure and operation of the first, second, and third electrode parts 191, 192, and 193 and the connection parts 194 of the Y electrodes 190 are similar to those of the first, second, and third electrode parts 181, 182, and 183 and the connection parts 184 of the X electrodes 180, and thus, the description thereof will not be repeated.

The front dielectric layer 115 covering the X electrodes 180 and the Y electrodes 190 is formed on the front substrate 111. The front dielectric layer 115 may be formed of a dielectric material that is capable of preventing direct electrical contact between the X electrodes 180 and the Y electrodes 190, that is capable of preventing the X electrodes 180 and the Y electrodes 190 from being damaged by collisions with positive ions or electrons, and that can accumulate wall charges by inducing charges.

Also, the protective layer 116 formed of MgO is formed on the front dielectric layer 115. The protective layer 116 prevents the front dielectric layer 115 from being damaged by collisions with positive ions and electrons when a discharge is generated, has high light transmittance, and generates a large amount of secondary electrons when a discharge is generated. In particular, the protective layer 116 is formed as a thin film by sputtering or electron beam evaporation.

The address electrodes 122 crossing the X electrodes 180 and the Y electrodes 190 are formed on the rear substrate 121 facing the front substrate 111. The purpose of the address electrodes 122 is to generate an address discharge that facilitates the generation of a sustain discharge between the X electrodes 180 and the Y electrodes 190. More specifically, the address electrodes 122 reduce the voltage required to generate a sustain discharge. The address discharge is generated between the Y electrodes 190 and the address electrodes 122. When the address discharge is completed, electrons are accumulated on the X electrodes 180 and positive ions are accumulated on the Y electrodes 190, thereby facilitating the generation of sustain discharge between the X electrodes 180 and the Y electrodes 190.

The rear dielectric layer 125 covering the address electrodes 122 is formed on the rear substrate 121. The rear dielectric layer 125 may be formed of a dielectric material that is capable of preventing the address electrodes 122 from being damaged by collisions with positive ions or electrons when a discharge is generated and that can induce charges.

The phosphor layer 126, including red, green, and blue phosphor layers, is formed on the side walls of the barrier ribs 130 and on the rear dielectric layer 125 between the barrier ribs 130 that define the discharge cells 170. The phosphor layer 126 includes an ingredient that emits visible light by receiving ultraviolet rays. A nonlimiting example of a suitable phosphor material for the red phosphor layer formed in the red light-emitting discharge cells includes $Y(V,P)O_4$:Eu. Nonlimiting examples of suitable phosphor materials for the green phosphor layer formed in the green light-emitting discharge cells includes $Zn_2SiO_4$:Mn, $YBO_3$:Tb, etc. A nonlimiting example of a suitable phosphor material for the blue phosphor layer formed in the blue light-emitting discharge cells includes BAM:Eu.

A discharge gas including a mixture of Ne gas and Xe gas is filled in the discharge cells 170. After the discharge gas is filled in the discharge cells 170, the front substrate 111 and the rear substrate 121 are coupled to each other using a sealing member such as glass frit formed on the edges of the front and rear substrates 111 and 121.

The bright room contrast ratios of plasma display panels can generally be increased using the following methods. One method of increasing the bright room contrast ratios of plasma display panels includes disposing a black stripe on a non-discharge region. However, the increase in the bright room contrast ratio is limited since the location and line width of the black stripe are limited. In particular, when each sustain electrode includes a plurality of electrode parts, the area occupied by the electrode parts is large. Accordingly, the line width of the black stripe is reduced, and thus, increases in the bright room contrast ratio are difficult to achieve.

Another method of increasing the bright room contrast ratios of plasma display panels includes disposing corresponding color filters in each of the plurality of red, green, and blue discharge cells. This method, however, requires additional filters, thereby increasing processes and costs.

Another method of increasing the bright room contrast ratios of plasma display panels includes coloring the entire front dielectric layer with a dark color. In this case, most of the visible light emitted from the discharge cells is absorbed by the dark front dielectric layer, thereby reducing brightness.

Another method of increasing the bright room contrast ratios of plasma display panels includes coloring the upper part of barrier ribs with a black color. In this case also, the visible light generated from the discharge cells is absorbed by the barrier ribs resulting in a reduction in brightness of approximately 10%.

However, the PDP 100 according to one embodiment of the present invention has a structure as described below that increases the bright room contrast ratio without encountering many of the above problems.

Referring to FIGS. 2 through 4, the front dielectric layer 115 is colored with a first color, and the barrier ribs 130 are colored with a second color. The front dielectric layer 115 and the barrier ribs 130 can be colored using various methods. For example, a pigment of the first or the second color is mixed with a dielectric paste for manufacturing the front dielectric layer 115 or the barrier ribs 130. The first and second colors have a subtractive color relationship such that the brightness and chroma are simultaneously reduced when the first and second colors are mixed. Accordingly, when the first and the second colors overlap, they produce a dark color. Thus, the reflective brightness of visible light entering from the outside is greatly reduced, thereby increasing the bright room contrast ratio of the PDP 100. In particular, if the first and second colors have a complementary color relationship, they appear as near black when they are mixed, and the light absorption rate is further increased, thereby further increasing the bright room contrast ratio of the PDP 100. In one embodiment, for example, the front dielectric layer 115 may have a first color in a yellow group, and the barrier ribs 130 may have a second color in a blue group.

Visible light generated in the discharge cells 170 is emitted to the outside mainly through the front dielectric layer 115. If the visible light is absorbed by the front dielectric layer 115, brightness of the PDP 100 is reduced. Also, the brightness of the PDP 100 is reduced when the visible light is absorbed by the barrier ribs 130 or when visible light is transmitted to other locations through the barrier ribs 130. Accordingly, the barrier ribs 130 may have high visible light reflectance. That is, the front dielectric layer 115 may be colored with a first color having higher visible light transmittance than the barrier ribs 130, and the barrier ribs 130 may be colored with a second color having a higher visible light reflectance than the front dielectric layer 115.

The overlapping of the front dielectric layer 115 with the barrier ribs 130 creates a portion that appears dark, which portion is a non-discharge region. Therefore, the reduction of brightness by the front dielectric layer 115 is greatly reduced. Also, since the barrier ribs 130 have a closed structure, regions of the barrier ribs 130 overlapping with the front dielectric layer 115 are increased, thereby greatly increasing the bright room contrast ratio of the PDP 100 without a reduction in brightness.

Operation of the PDP 100 having the above structure according to one embodiment of the present invention will now be described.

An address discharge is generated between the address electrodes 122 and the Y electrodes 190. As a result of the address discharge, discharge cells 170 where a sustain discharge is generated are selected. After selection of the discharge cells 170, a sustain voltage is applied between the X electrodes 180 and the Y electrodes 190 of the selected discharge cells 170, and a sustain discharge is generated by colliding positive ions accumulated on the Y electrodes 190 with electrons accumulated on the X electrodes 180. The sustain discharge is continuously generated by changing voltage pulses applied to the X electrodes 180 and the Y electrodes 190. In generating the sustain discharges between the X electrodes 180 and the Y electrodes 190, the sustain discharge is initiated between the third electrode parts 183 of the X electrodes 180 and the third electrode parts 193 of the Y electrodes 190, i.e., where the discharge gap is the narrowest. The discharge is then continuously extended to the second electrode parts 182 and 192 and the first electrode parts 181 and 191.

Ultraviolet rays are emitted due to the reduction of the energy level of the discharge gas which is excited during the sustain discharge. The ultraviolet rays excite the phosphor layer 126 coated on the discharge cells 170, and visible light is emitted from the phosphor layer 126 as the reduction of the energy level of the phosphor layer 126 is reduced. The visible light emitted from the discharge cells 170 forms images.

Figure 5:
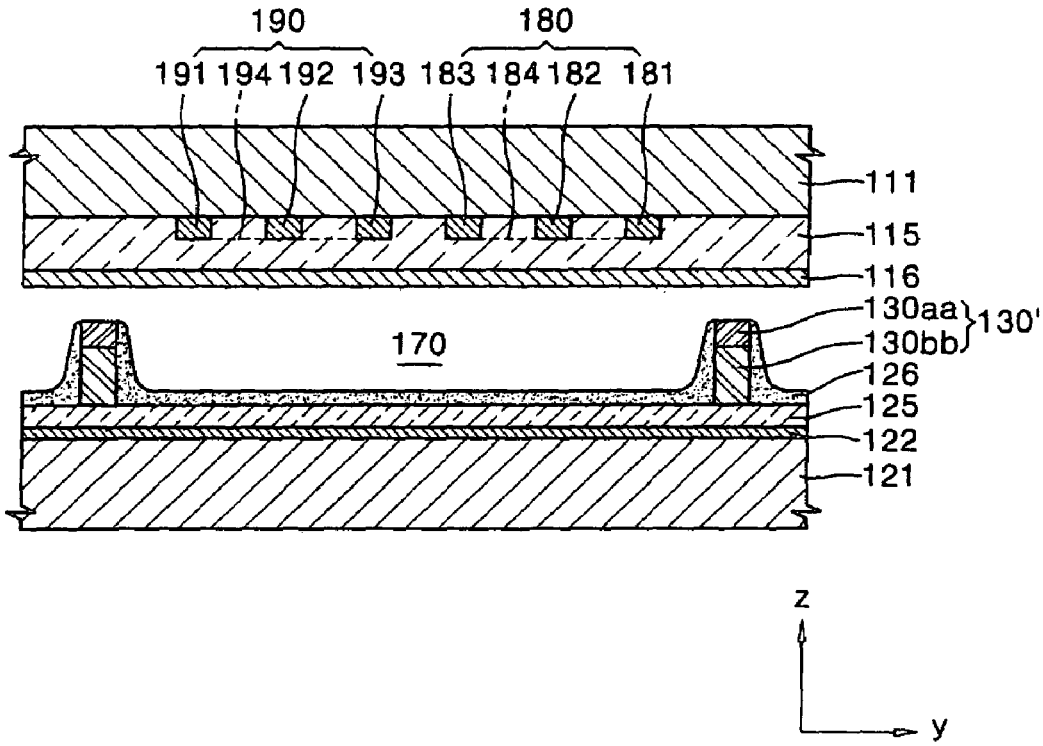
FIG. 5 is a cross-sectional view of a PDP according to another embodiment of the present invention.

FIG. 5 is a cross-sectional view of a PDP 100 according to another embodiment the present invention. In FIGS. 2 through 5, like reference numerals denote like elements. Referring to FIG. 5, a barrier rib 130' includes a lower barrier rib part **130*bb* disposed on a rear dielectric layer 125 and an upper barrier rib part 130*aa* disposed on a lower barrier rib part 130*bb*. The upper barrier rib part 130*aa* is colored with the second color which is subtractive relative to the first color of the front dielectric layer 115. The lower barrier rib part 130*bb* is colored with a white group color to increase visible light reflectance. Also, when only the front dielectric layer 115 and the upper barrier rib part 130*aa* are subtractively mixed, a user primarily sees the upper barrier rib part 130*aa* rather than the lower barrier rib part 130*bb* since the user sees the PDP through the front substrate 111. Accordingly, although only the upper barrier rib part 130*aa*** has a color that is subtractive relative to the first color, an increased bright room contrast ratio is achieved.

Another embodiment of the present invention that also increases the bright room contrast ratio has the same structure as depicted in FIGS. 2 through 4 and will now be described in detail.

A rear substrate 121, or the rear dielectric layer 125, can be colored a third color which is subtractive relative to the first color of the front dielectric layer 115. That is, brightness and chroma of the third color are reduced at the same time when the third color is mixed with the first color of the front dielectric layer 115. In particular, when the first and third colors have a complementary color relationship, they appear as near black when they are mixed. Therefore, the absorption rate of visible light entering from the outside is further increased, thereby further increasing the bright room contrast ratio. In this embodiment, the barrier ribs 130 can be colored with various groups of colors, and may be colored white to increase the reflectance of visible light. As described above, since the first color of the front dielectric layer 115 is subtractively mixed with the third color of the rear substrate 121 or the rear dielectric layer 125, the reflective brightness of external light is greatly reduced, thereby increasing the bright room contrast ratio. In one embodiment, the front dielectric layer 115 may be colored with a yellow group first color, and the rear substrate 121 or the rear dielectric layer 125 may be colored with a blue group second color.

The PDPs according to the present invention have many features. For example, sustain electrodes can be formed in one unit using the same material, thereby reducing manufacturing costs and simplifying the manufacturing process.

In addition, since the front dielectric layer has a color that can be subtractively mixed with one of the barrier ribs, the rear substrate, or the rear dielectric layer, the reflective brightness of the PDP is reduced, thereby increasing the bright room contrast ratio. In particular, the transmittance of visible light through the front dielectric layer is increased, and the reflective brightness of external light can be reduced by subtractively mixing the color of the front dielectric layer with colors of other components.

While certain exemplary embodiments of the present invention have been illustrated and described, it will be understood by those of ordinary skill in the art that various changes and modifications may be made to the described embodiments without departing from the spirit and scope of the present invention as defined in the following claims and their equivalents.

What is claimed is:

1. A plasma display panel comprising:

a front substrate adapted to allow visible light to pass;

a rear substrate facing the front substrate;

a plurality of barrier ribs disposed between the front substrate and the rear substrate, the plurality of barrier ribs defining a plurality of discharge cells, wherein at least a portion of the barrier ribs is colored with a first color;

a plurality of sustain electrodes disposed on the front substrate facing the rear substrate; and a front dielectric layer disposed on the front substrate covering the sustain electrodes, wherein the front dielectric layer is colored with a second color, wherein the first and second colors are subtractively mixed, and wherein one of the first and second colors is a blue group color, and the other of the first and second colors is a yellow group color.

2. The plasma display panel of claim 1, wherein the first and second colors have a complementary color relationship whereby the first and second colors appear black when they are subtractively mixed.

3. The plasma display panel of claim 1, wherein the first color is the blue group color and the second color is the yellow group color.

4. The plasma display panel of claim 1, wherein the barrier ribs have a visible light reflectance greater than that of the front dielectric layer.

5. The plasma display panel of claim 1, wherein the front dielectric layer has a visible light transmittance greater than that of the barrier ribs.

6. The plasma display panel of claim 1, wherein each of the plurality of barrier ribs comprises an upper barrier rib portion and a lower barrier rib portion, wherein the portion of the barrier rib that is colored with the first color is the upper barrier rib portion.

7. The plasma display panel of claim 1, wherein the barrier ribs are entirely colored.

8. The plasma display panel of claim 1, wherein each of the sustain electrodes comprises a plurality of electrode parts, the plurality of electrode parts extending substantially parallel to each other.

9. The plasma display panel of claim 1, wherein each of the sustain electrodes comprises a plurality of electrode parts and a plurality of connection parts electrically connecting the electrode parts.

10. The plasma display panel of claim 1, wherein the barrier ribs are closed-type barrier ribs.

11. A plasma display panel comprising:

a front substrate adapted to allow visible light to pass;

a rear substrate facing the front substrate, the rear substrate being colored with a first color;

a plurality of sustain electrodes disposed on the front substrate facing the rear substrate; and a front dielectric layer disposed on the front substrate covering the sustain electrodes, wherein the front dielectric layer is colored with a second color, wherein the first and second colors are subtractively mixed.

12. The plasma display panel of claim 11, wherein the first and second colors have a complementary color relationship whereby the first and second colors appear black when they are subtractively mixed.

13. The plasma display panel of claim 11, wherein the first color is a blue group color and the second color is a yellow group color.

14. The plasma display panel of claim 11, wherein each of the sustain electrodes comprises a plurality of electrode parts, wherein the plurality of electrode parts extend substantially parallel to each other.

15. The plasma display panel of claim 11, wherein each of the sustain electrodes comprises a plurality of electrode parts and a plurality of connection parts electrically connecting the electrode parts.

16. A plasma display panel comprising:

a front substrate adapted to allow visible light to pass;

a rear substrate facing the front substrate;

a plurality of sustain electrodes disposed on the front substrate facing the rear substrate;

a front dielectric layer disposed on the front substrate covering the sustain electrodes, wherein the front dielectric layer is colored with a first color;

a plurality of address electrodes extending substantially perpendicular to the sustain electrodes, the address electrodes being disposed on the rear substrate facing the front substrate; and a rear dielectric layer disposed on the rear substrate covering the address electrodes, wherein the rear dielectric layer is colored with a second color, wherein the first and second colors are subtractively mixed.

17. The plasma display panel of claim 16, wherein the first and second colors have a complementary color relationship whereby the first and second colors appear black when they are subtractively mixed.

18. The plasma display panel of claim 16, wherein the first color is a blue group color and the second color is a yellow group color.

19. The plasma display panel of claim 16, wherein the sustain electrodes comprise a plurality of electrode parts, the electrode parts of a portion of the sustain electrodes extending substantially parallel to each other.

20. The plasma display panel of claim 16, wherein each of the sustain electrodes comprises a plurality of electrode parts and a plurality of connection parts electrically connecting the electrode parts.

* * * * *